United States Patent [19]

Pietkiewicz et al.

[11] Patent Number: 4,633,165

[45] Date of Patent: Dec. 30, 1986

[54] TEMPERATURE COMPENSATED VOLTAGE REFERENCE

[75] Inventors: Steven M. Pietkiewicz, Fremont; Derek F. Bowers, Sunnyvale, both of Calif.

[73] Assignee: Precision Monolithics, Inc., Santa Clara, Calif.

[21] Appl. No.: 640,995

[22] Filed: Aug. 15, 1984

[51] Int. Cl.[4] ..... G05F 3/20

[52] U.S. Cl. ..... 323/314; 323/316; 323/354; 323/907

[58] Field of Search ..... 323/312, 313, 314, 315, 323/316, 353, 354, 907; 307/296 R, 297, 310

[56] References Cited

U.S. PATENT DOCUMENTS 4,100,437 7/1978 Hoff, Jr. ..... 323/314 X
4,176,308 11/1979 Dobkin et al. ..... 323/316 X

OTHER PUBLICATIONS

G. McGlinchey, "A Monolithic 12b 3us ADC", 1982 IEEE International Solid-State Circuits Conference Digest, pp. 80, 81, 296 and 297.

*Primary Examiner*—Peter S. Wong
*Attorney, Agent, or Firm*—Koppel & Harris

[57] ABSTRACT

A temperature compensated voltage reference circuit in which a compensation current is generated by establishing a current through a passive impedance element which varies with temperature in accordance with the transistor voltage equation. This current is proportionately reflected into the output impedance circuit associated with the voltage reference, where it compensates for temperature induced voltage variations. The passive impedance element is adjustable to correct for processing variations, and the compensation circuit requires no voltage supplies other than those typically provided for the reference circuit by itself.

14 Claims, 4 Drawing Figures

TEMPERATURE COMPENSATED VOLTAGE REFERENCE

BACKGROUND OF THE INVENTION

1. Field of the Invention

This invention relates to voltage reference circuits, and more particularly to a voltage reference circuit which is characterized by an output voltage which varies with temperature in a predetermined manner, and which includes a compensation subcircuit to adjust the reference output in a manner complementary to its natural temperature variation, thereby reducing the reference's net temperature variation.

2. Description of the Prior Art

Voltage references are required to provide a substantially constant output voltage irrespective of changes in input voltage, output current or temperature. Such references are used in many design applications, such as digital-to-analog convertors, power supplies, cold junction thermistor compensation circuits, analog-to-digital convertors, panel meters, calibration standards, precision current sources and control set-point circuits.

Modern voltage references are generally based on either zener diodes or bandgap generated voltages. Zener devices characteristically exhibit high power dissipation and poor noise specifications. Bandgap voltage references, on the other hand, are designed to yield stable output voltages over temperature by summing a pair of voltages with negative and psoitive temperature coefficients. A voltage with a negative temperature coefficient is obtained from the base-emitter junction of a transistor, while a voltage with a positive temperature coefficient is obtained from the difference between the base-emitter voltages of two transistors operating with unequal current densities. When the differential voltage is amplified and added to the base-emitter voltage of the first transistor, a voltage level with a very low temperature coefficient results if the sum equals 1.23 volts. The 1.23 volt level is then amplified to provide stable output voltages of typically 5.0 and 10.0 volts.

Presently available bandgap voltage references are unfortunately not totally insensitive to temperature, and in some cases the temperature dependence reaches unacceptable levels. A prior art circuit which was developed in an attempt to balance out temperature induced voltage variations is illustrated in FIG. 1, which is a simplification of the circuit described in an article by G. McGlinchey, "A Monolithic 12b 3 us ADC", 1982 IEEE International Solid-State Circuits Conference Digest, page 296, FIG. 4. This circuit has a temperature compensation feature which noticeably reduces the temperature dependence of the output reference voltage. However, the circuit requires both a positive and a negative voltage supply, whereas stand alone voltage references normally require only a positive voltage supply. The user would normally have to provide the negative voltage supply, thus adding to the cost and complexity of the system. Furthermore, this prior art circuit has no convenient mechanism to compensate for processing variations, which effect the nature of its temperature dependence.

Referring to the details of the FIG. 1 circuit, a bandgap voltage reference circuit 2 is shown enclosed in dashed lines. The circuit includes an output amplifier 4, a resistor-transistor network 6 which provides positive and negative inputs to the amplifier, a positive voltage supply terminal 8 and an output impedance circuit consisting of resistors R1 and R2 connected in series between the output of amplifier 4 and ground. The junction between R1 and R2 serves as a bias point for transistors in the reference circuit.

The reference voltage at the output of amplifier 4 supplies power to a pair of current sources I1 and I2, which are connected to ground through diode-connected transistors T1 and T2, respectively. The magnitude of I1 is set at a constant value $I_c$, typically 60 microamps. The magnitude of I2 is set equal to I1 times $T/T_0$, where T is absolute temperature and $T_0$ is reference temperature, typically 25° C. The McGlinchey reference illustrates circuitry which may be used to establish I1 and I2. The bases of T1 and T2 provide differential inputs to a differential amplifier consisting of transistors T3 and T4, the emitters of which are connected together. A current source I3 is connected to a negative voltage supply terminal 10 and draws current through the differential amplifier transistors.

The collectors of differential amplifier transistors T3 and T4 are coupled together by means of a mirror circuit comprising transistors T5 and T6, the mirror circuit being supplied with power from the reference voltage output terminal. The current through T4 relative to T3 is established by the current through T2 relative to T1, which in turn varies with temperature in accordance with the relationship $T/T_0$ between I2 and I1. When the temperature rises above $T_0$, the current transmitted through T2 by I2 increases by an amount proportional to the temperature rise above $T_0$. The greater bias on T4 increases the current flow through that transistor, which through the action of the differential amplifier produces a corresponding drop in the current through T3. The current through T5, which is connected in series with T3, will drop by the same amount as the current drop through T3, and this current drop is reflected by the mirror circuit as a similar drop through T6. The current through T6, which is connected in series with T4, will thus be less than the current through T4 by an amount equal to the combined current rise through T4 and the current drop through T3.

The difference between the T4 and T6 currents is supplied as an output corrective current $I_0$ over line 12 from the junction of R1 and R2 in the voltage reference output impedance circuit. This current is delivered from the voltage reference output through R1, thus increasing both the voltage across R1 and the reference voltage at the output $V_0$ of amplifier 4. In this manner a drop in the reference voltage resulting from a temperature rise is compensated by an increase in the compensation current delivered along line 12 to the output impedance circuit, which tends to compensate for the reference voltage swing.

The above compensation technique is illustrated in FIGS. 2 and 3. FIG. 2 illustrates the output reference voltage without temperature compensation. The voltage is at a desired reference value at temperature $T_0$ at the lower end of its operating temperature range, and prgressively drops as the temperature increases. Its value has been found to be a function of $(kT/q)\ln(T/T_0)$, where k is Boltzmann's constant and q is the electronic charge. The compensation current $I_0$, illustrated in FIG. 3, begins at substantially zero at a temperature of $T_0$, and progressively increases with increasing temperature. The circuit is designed so that the reference output voltage adjustment produced by $I_0$ substantially balances out the reduction in the reference voltage caused by increasing temperature, resulting in a substantially constant output reference voltage (the slopes of the curves in both FIGS. 2 and 3 are exaggerated for purposes of illustation).

While the described compensation circuit considerably improves the temperature performance of the voltage reference circuit, as noted above it requires a negative voltage supply that otherwise would not be needed. In addition, it requires a matching of numerous circuit elements in order to conveniently adjust the circuit to compensate for processing variations in its manufacture.

SUMMARY OF THE INVENTION

In view of the above problems associated with the prior art, the object of the present invention is to provide a temperature compensated voltage reference circuit having a voltage output which is substantially insensitive to temperature variations over a predetermined temperature range, which requires no additional power supplies, and which can conveniently be adjusted to compensate for processing variations.

In the accomplishment of these and other objects of the invention, a voltage reference circuit is provided with a temperature compensation circuit that includes a passive impedance element (preferably a resistor), rather than the prior art differential amplifier, for generating a current differential which is reflected back to the output reference impedance circuit as a compensating current. A pair of matched transistors are respectively supplied with the I1 and I2 currents, with the passive impedance element connected between their bases to conduct a current which is proportional to their base voltage differential. This current is reflected by a current mirror to produce a proportionate compensating current for the reference output circuit. The only external voltage required, other than a ground reference, is the normal positive voltage supply for the voltage reference circuit.

In a preferred embodiment the resistor is made variable, such as by the provision of a trimming circuit, to compensate for processing variations in the reference circuit. A pair of transistors couple opposite sides of the resistor to the current mirror, and are supplied with quiescent current by means of a pair of high resistance elements which are connected between opposite ends of the resistor and ground. The compensation current is fed into the voltage reference output circuit at an intermediate location to avoid saturating the coupling transistors.

Further objects and features of the invention will be apparent to those skilled in the art from the following description of a preferred embodiment, taken together with the accompanying drawings, in which:

DESCRIPTION OF A PREFERRED EMBODIMENT

Figures 1, 2, 3:
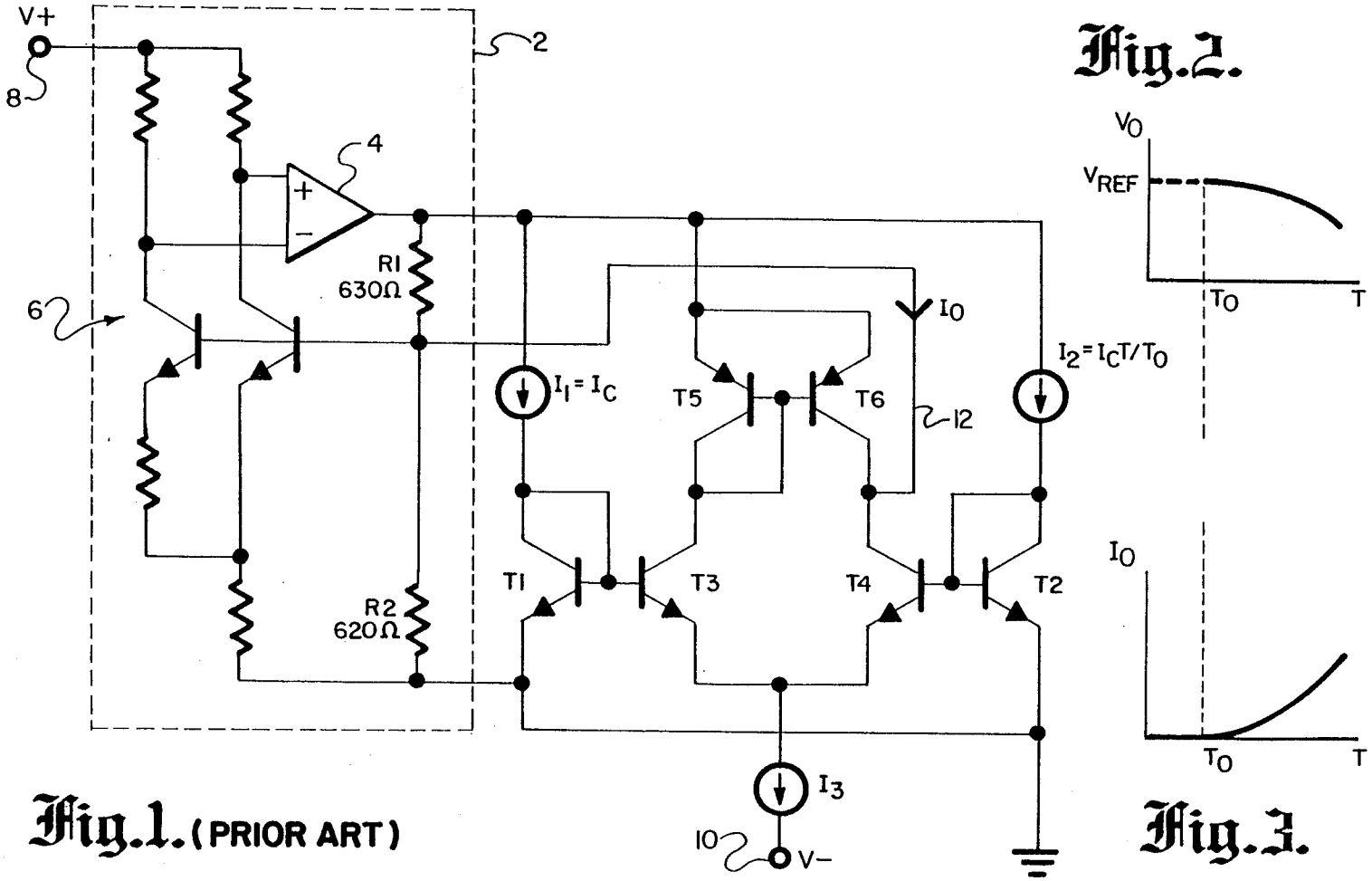
Fig.1. (PRIOR ART)
FIG. 1 is a schematic diagram of a prior art voltage reference circuit with a temperature compensation feature.
FIGS. 2 and 3 are out of scale graphs illustrating the temperature dependence of the uncompensated voltage reference and of the compensation current, respectively, of both the prior art circuit of FIG. 1 and of the present invention.
Figure 4:
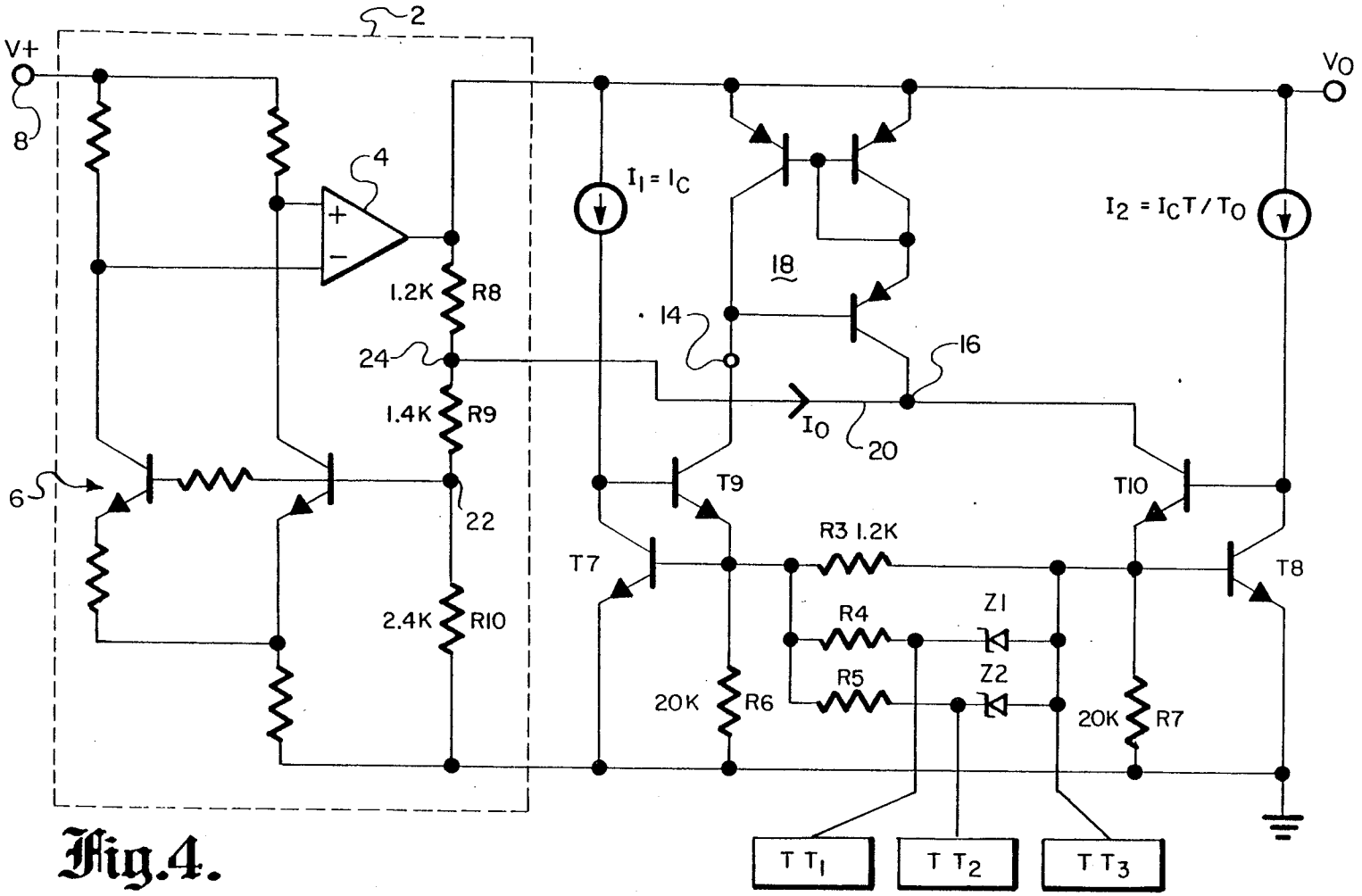
FIG. 4 is a schematic diagram of a preferred embodiment of the present invention.

Referring to FIG. 4, a preferred embodiment of the invention is shown in which a temperature compensation circuit is employed in conjunction with a bandgap voltage reference 2 which, except for its output impedance circuit, is essentially the same as the voltage reference in the prior art circuit of FIG. 1. In FIG. 4 the same reference numerals are used to indicate elements which correspond to the elements of FIG. 1. A constant current $I_c$ is generated by current source I1 in a conventional manner, and a temperature dependent current with a magnitude equal to $I_0$ $(T/T_0)$ is generated in a similarly conventional manner by current source I2. I1 is connected between the reference output voltage bus $V_0$ through the collector-emitter circuit of a transistor T7 to ground, while I2 is connected from the output reference voltage bus $V_0$ through the collector-emitter circuit of another transistor T8 to ground.

A principal difference between the present invention as embodied in FIG. 4 and the prior art circuit of FIG. 1 lies in the substitution of a passive impedance element, preferably in the form of resistor R3, for the differential amplifier T3, T4 of FIG. 1. R3 is connected between the bases of T7 and T8, and conducts a current which is proportional to the voltage differential between the two transistor bases. The current through R3 is ultimately reflected back to the output impedance circuit of the voltage reference to perform a temperature compensation function.

The value of R3 is adjustable so that the magnitude of its current can be altered to compensate for processing variations in the manufacture of the voltage reference circuit. For example, processing variation might cause the actual output voltage-temperature curve to have a somewhat greater slope than that illustrated in FIG. 2. In that case, the resistance of R3 would be reduced, thereby producing a proportionate increase in both the current through R3 and in the temperature compensation provided to the voltage reference.

Several mechanisms for adjusting the resistance value of R3 could be used, such as "zener zap" trimming, laser trimming, or providing R3 as a potentiometer. The preferred method is zener zap, which is illustrated in FIG. 4. While numerous implementations of this technique are possible, in FIG. 4 R3 is paralleled by adjustment resistors R4 and R5, which are connected in series with zener diodes Z1 and Z2, respectively. Trimming terminals TT1 and TT2 are provided for transmitting externally applied "zap" voltages to Z1 and Z2, respectively, with a third trimming terminal TT3 connected to the common zener anodes to provide a reference voltage. In normal operation the R4 and R5 circuits are effectively open circuited by Z1 and Z2. Upon the application of a reference voltage to TT3 and appropriate external voltages to TT1 and/or TT2, their respective zener diodes are shorted out. This completes the R4, R5 circuits, thus reducing the effective resistance of R3 by adding a series of parallel paths. Additional zener controlled sections could be added for greater trimming resolution. As opposed to a matching of numerous elements which is necessary to achieve an adjustment capability in the prior art FIG. 1 circuit, in the implementation of the present invention shown in FIG. 4 it is necessary that only R3 be approximately the same size as the reference output resistors R8 and R9, discussed below, to achieve the described adjustability.

The opposite ends of R3 are coupled via transistors T9 and T10, respectively, to a current mirror circuit. T9 and T10 are preferably provided in the form of npn transistors which are matched with T7 and T8. The emitters of T9 and T10 are connected respectively to the bases of T7 and T8 and to opposite ends of R3, their bases are connected respectively to the collectors of T7 and T8, and their collectors are connected respectively to the current mirror input and output terminals 14 and 16. Resistors R6 and R7 are connected between ground and the junctions between the opposite ends of R3 and T9, T10, respectively.

The current mirror 18 is preferably provided in the form of a conventional Wilson current mirror, rather than the two-transistor mirror employed in the prior art circuit of FIG. 1, for improved accuracy. The current mirror, which is supplied with power from the reference circuit output terminal $V_O$, reflects an input current flowing through input terminal 14 into the collector of T9 as an equal output current flowing into output terminal 16.

Although the mirror input and output currents are by definition equal, the collector currents of T9 and T10 are not equal whenever the temperature differs from $T_0$. If the temperature is greater than $T_0$, I2 will be greater than I1 and the base voltage of T8 will be greater than the base voltage of T7 by an amount determined by the well known transistor equations. Based upon these equations, the base-emitter voltages of T7 and T8 will vary in proportion to the natural logarithm of the quotient of their collector currents divided by their saturation currents. Since the emitter of each transistor is grounded, its base voltage will accordingly vary directly with the logarithm of this current quotient.

The base voltage differential between T8 and T7 causes a current to flow through R3, from T8 towards T7. This current is supplied by an increase in the collector-emitter current of T10. The R3 current is returned to ground through R6, causing the collector-emitter current through T9 to drop by an amount equal to the R3 current in order to maintain the current balance at the junction of R3 and R6. The reduced current through T9 produces a corresponding reduction in the current from the mirror input terminal 14. This current drop is reflected by the mirror as an equal drop in the current delivered to mirror output terminal 16. Since the collector-emitter current of T10 has increased by the R3 current and the mirror output current into terminal 16 has decreased by the R3 current (ignoring base currents), a current imbalance equal to twice the current through R3 is established between the mirror output current and the collector of T10. Compensation line 20 is provided between the mirror output terminal 16 and the voltage reference output impedance circuit to supply an output compensation current $I_0$ which corrects this imbalance. $I_0$ provides the desired temperature compensation to keep the reference voltage output steady over a desired temperature range.

Starting from the logarithmic relationship between transistor voltage and current as dictated by the transistor equations, it can be demonstrated that the current through R3 will vary with the expression $(kT/q)\ln(T/T_0)$. Since the output of the voltage reference varies in accordance with $T\ln(T/T_0)$, an appropriate selection of the various resistance values will permit a precise matching of the compensation current $I_0$ to the actual reference circuit temperature characteristic.

Resistors R6 and R7 have a much higher resistance value than R3, and provide quiescent current to T9 and T10 so that these transistors remain on even at a temperature of $T_0$, at which no current flows through R3. This function of R6 and R7 could be provided by a pair of current sources, but high value resistors are the simplest implementation.

Another improvement which the invention offers over the prior art is the manner in which the compensation current line 20 is connected to the voltage reference circuit. Referring back to the prior art circuit of FIG. 1, the compensation current is brought into the output impedance circuit at the junction between R1 and R2. This point is typically maintained at 1.205 volts. In the FIG. 4 circuit of the present invention, three resistors R8, R9 and R10 are connected in series between the reference output terminal $V_0$ and ground, with the junction 22 between R9 and R10 typically maintained at the same 1.205 volts as in the prior art and providing a bias for transistors in the voltage reference circuit. Rather than bring the compensation current in at junction 22, line 20 is connected to an intermediate location between junction 22 and $V_0$ by employing two series resistors R8, R9 and connecting line 20 to the junction 24 between the two. This produces an elevation of the collector voltage for T10, thus maintaining a reverse bias on that transistor. This is desirable because, with typical base-emitter voltage drops of 0.7 volts, the base voltage of T10 will typically be at about 1.4 volts, since it is separated from ground by the base emitter circuits of T10 and T8. If the current compensation line 20 were connected to the 1.205 volt point 22 in the output impedance circuit, the collector of T10 would be at a lower voltage than its base, and the transistor would be slightly forward biased. While the circuit would probably still operate because the amount of forward bias is not excessive, it is preferable that a reverse bias be maintained on T10.

The described circuit has been found to operate with a very high degree of accuracy over the entire military temperature range of −55° C. to 125° C. The ability to adjust R3 has resulted in smaller errors than in the past, and the elimination of the need for a negative voltage supply has simplified and reduced the cost of using the voltage reference circuit.

While a particular embodiment of the invention has been shown and described, various modifications and alternate embodiments will occur to those skilled in the art. Accordingly, it is intended that the invention be limited only in terms of the following claims:

We claim:

1. A temperature compensated voltage reference circuit, comprising:

a voltage reference circuit adapted to generate an output reference voltage which varies with temperature, a passive impedance element, means for generating a current through the impedance element which varies with temperature in a manner complementary to the temperature variance of the output reference voltage, said current generating means comprising:

means for establishing a first current which is substantially temperature-invariant, means for establishing a second current which varies with temperature, first and second circuit means having output voltages which vary with their respective input currents, means for applying the first and second currents as input currents to the first and second circuit means, respectively, and means for applying the output voltage differential between the first and second circuit means across the passive impedance element, and means responsive to said generated current for adjusting the output reference voltage to substantially compensate for its temperature dependence.

2. The temperature compensated voltage reference circuit of claim 1, said passive impedance element comprising an adjustable resistor having an adjustment range to compensate for processing variations in manufacturing the voltage reference circuit.

3. A temperature compensated voltage reference circuit, comprising:

a voltage reference circuit adapted to generate an output reference voltage which varies in accordance with $T\ln(T/T_0)$, where T is temperature and $T_0$ is a reference temperature, the voltage reference circuit including an output impedance circuit, first and second matched transistors having one side of their collector-emitter circuits connected to a common voltage potential, first and second current sources connected to drive first and second currents respectively through the collector-emitter circuits of the first and second transistors, the first current being substantially $T/T_0$ times the magnitude of the second current, whereby the base voltage differential between the two transistors varies substantially in accordance with $T\ln(T/T_0)$, a passive impedance element connected between the bases of the two transistors to conduct a current which is proportional to the base voltage differential, and means for deriving from the impedance element current an adjustment current which varies in accordance with $T\ln(T/T_0)$, and for applying said adjustment current to the voltage reference output impedance circuit to compensate for temperature variations in the reference circuit output.

4. The voltage reference circuit of claim 3, said passive impedance element comprising a resistor, and further comprising means for trimming the resistor to compensate for processing variations in manufacturing the voltage reference circuit.

5. The voltage reference circuit of claim 3, wherein the common voltage potential for the first and second transistors is ground potential.

6. A circuit for generating a current which varies in accordance with $T\ln(T/T_0)$, where T is temperature and $T_0$ is a reference temperature comprising:

first and second matched transistors having one side of their collector-emitter circuits connected to a common voltage potential, first and second current sources connected to drive first and second currents respectively through the collector-emitter circuits of the first and second transistors, the first current being substantially $T/T_o$ times the magnitude of the second current, and the base voltage differential between the two transistors varying in accordance with $T\ln(T/T_0)$, a passive impedance element connected between the bases of the two transistors to conduct a current which is proportional to the base voltage differential and which also varies logarithmically with $T/T_0$, and current mirror means having input and output terminals connected in circuit across the passive impedance element for deriving an output current which is proportional to the impedance element current.

7. The current generating circuit of claim 6, said passive impedance element comprising an adjustable resistor having an adjustable resistance value to permit adjustment of the output current.

8. The current generating circuit of claim 6, wherein the common voltage potential for the first and second transistors is at ground potential.

9. A temperature compensated voltage reference circuit, comprising:

a voltage reference circuit adapted to operate from a positive power supply and to generate an output reference voltage which varies with temperature (T) with respect to a reference temperature ($T_0$), the voltage reference circuit including an output impedance circuit, first and second matched temperature dependent npn transistors having their emitters grounded, first and second current sources connected to supply first and second currents to the collectors of the first and second transistors, respectively, the first current being substantially $T/T_0$ times the magnitude of the second current, a compensation resistor connected between the bases of the two transistors to conduct a current which is proportional to the base voltage differential, a mirror circuit having an input and an output terminal, third and fourth temperature dependent npn transistors having their bases connected to the collectors of the first and second transistors, respectively, their emitters connected to opposite sides of the resistor, and their collectors connected to the mirror input and output terminals, respectively, whereby the differential between the current at the mirror output terminal and the collector current of the fourth transistor is temperature dependent and in substantially direct proportion to the resistor current, and means connecting the mirror output terminal with the voltage reference output impedance circuit to apply said differential current as a temperature compensating current to the impedance circuit.

10. The temperature compensated voltage reference circuit of claim 9, further comprising means for trimming said resistor to compensate for processing variations in manufacturing the voltage reference circuit.

11. The temperature compensated voltage reference circuit of claim 9, the output reference voltage supplying a bias voltage for the mirror circuit, whereby only a single power supply is required to operate the voltage reference circuit.

12. The temperature compensated voltage reference circuit of claim 9, further comprising means for providing quiescent current to the third and fourth transistors.

13. The temperature compensated voltage reference circuit of claim 12, said quiescent current means comprising resistors having substantially greater resistances than the compensation resistor and connected between opposite ends of the compensation resistor and ground.

14. The temperature compensated voltage reference circuit of claim 9, said output impedance circuit comprising a plurality of resistors connected in series between the voltage reference output and ground, a bias line for the voltage reference circuit connected to a relatively low voltage location in the resistor series, and said differential current connecting means applying the differential current to an intermediate voltage location in the resistor series between the voltage reference output and said low voltage location, said intermediate location being maintained at a voltage at least equal to the base voltage of the fourth transistor.

* * * * *